US009469955B2

(12) United States Patent
Ferraiolo

(10) Patent No.: US 9,469,955 B2
(45) Date of Patent: Oct. 18, 2016

(54) REINFORCED GABION AND PROCESS FOR ITS MANUFACTURE

(71) Applicant: Francesco Ferraiolo, Ca' de' Fabbri (IT)

(72) Inventor: Francesco Ferraiolo, Ca' de' Fabbri (IT)

(73) Assignee: OFFICINE MACCAFERRI S.P.A., Zola Predosa (BO) (IT)

( * ) Notice: Subject to any disclaimer, the term of this patent is extended or adjusted under 35 U.S.C. 154(b) by 0 days.

(21) Appl. No.: 14/385,914

(22) PCT Filed: Mar. 7, 2013

(86) PCT No.: PCT/IB2013/051829

§ 371 (c)(1),
(2) Date: Sep. 17, 2014

(87) PCT Pub. No.: WO2013/140290

PCT Pub. Date: Sep. 26, 2013

(65) Prior Publication Data

US 2015/0071708 A1 Mar. 12, 2015

(30) Foreign Application Priority Data

Mar. 21, 2012 (IT) ..... BO2012A0151

(51) Int. Cl.

| | |
|---|---|
| ***E02D 29/02*** | (2006.01) |
| ***E02D 17/20*** | (2006.01) |
| ***E02B 3/10*** | (2006.01) |
| ***B21F 27/00*** | (2006.01) |
| ***B21F 27/12*** | (2006.01) |

(52) U.S. Cl.

CPC ..... *E02B 3/108* (2013.01); *B21F 27/005* (2013.01); *B21F 27/128* (2013.01); *E02D 29/0208* (2013.01); *E02D 29/0241* (2013.01)

(58) Field of Classification Search

CPC ... E02D 29/0208; B21F 27/00; B21F 27/005
See application file for complete search history.

(56) References Cited

U.S. PATENT DOCUMENTS 3,682,419 A * 8/1972 Vanderfaeillie ..... 245/7
4,081,159 A 3/1978 Baldwin (Continued)

FOREIGN PATENT DOCUMENTS

CA 2 023 581 A 2/1992
CN 201053115 Y 4/2008

(Continued)

OTHER PUBLICATIONS

Form PCT/ISA/220 Notification of Transmittal of the International Search Report and the Written Opinion issued in International Application No. PCT/IB2013/051829, date of mailing Sep. 10, 2013 (1 page).

(Continued)

*Primary Examiner* — Frederick L Lagman
(74) *Attorney, Agent, or Firm* — Flynn, Thiel, Boutell & Tanis, P.C.

(57) ABSTRACT

A reinforced gabion comprising two adjacent walls with a common edge manufactured using a single sheet of double twisted metal mesh fabric formed from metal wires which have two different diameters respectively corresponding to the two walls. Preferably the metal mesh fabric has a mesh with at least one twisted side formed from at least two metal wires woven together in which each twisted side is aligned in the direction of the common edge between the two walls.

8 Claims, 3 Drawing Sheets

(56) References Cited

U.S. PATENT DOCUMENTS

| | | | | | |
|---|---|---|---|---|---|
| 4,394,924 | A | | 7/1983 | Zaccheroni | |
| 4,425,057 | A | * | 1/1984 | Hahn | 405/288 |
| 4,477,206 | A | * | 10/1984 | Papetti et al. | 405/172 |
| 5,076,735 | A | * | 12/1991 | Hilfiker | 405/284 |
| 5,161,917 | A | * | 11/1992 | Papetti | 405/284 |
| 5,582,492 | A | | 12/1996 | Doyle, Jr. | |
| 5,636,938 | A | | 6/1997 | Ragazzo | |
| 8,596,926 | B2 | | 12/2013 | Heselden | |
| 2010/0024343 | A1 | * | 2/2010 | Eggermont | 52/648.1 |
| 2010/0172701 | A1 | * | 7/2010 | Tucker et al. | 405/284 |
| 2010/0193512 | A1 | | 8/2010 | Heselden | |
| 2010/0224736 | A1 | | 9/2010 | Chen et al. | |

FOREIGN PATENT DOCUMENTS

| | | | | |
|---|---|---|---|---|
| CN | 101680203 | A | | 3/2010 |
| CN | 101824826 | A | | 9/2010 |
| EP | 1983068 | | * | 8/2007 |
| EP | 1881114 | | * | 1/2008 |
| EP | 2 317 014 | A1 | | 5/2011 |
| FR | 2947287 | A1 | | 12/2010 |
| GB | 726859 | A | | 3/1955 |
| GB | 955938 | | | 4/1964 |
| JP | 2001-49638 | A | | 2/2001 |
| JP | 2011252330 | A | * | 12/2011 |
| JP | 2012255308 | A | * | 12/2012 |
| KR | 20030090246 | | * | 11/2003 |
| WO | WO 00/40810 | A1 | | 7/2000 |
| WO | WO 02/36883 | A1 | | 5/2002 |

OTHER PUBLICATIONS

Form PCT/ISA/210 International Search Report issued in International Application No. PCT/IB2013/051829, date of mailing Sep. 10, 2013 (3 pages).

Form PCT/ISA/237 Written Opinion of the International Searching Authority issued in International Application No. PCT/IB2013/051829, date of mailing Sep. 10, 2013 (4 pages).

Response dated Feb. 20, 2014 responding to the Written Opinion of the International Searching Authority issued on Sep. 10, 2013 in International Application No. PCT/IB2013/051829 (2 pages).

Invitation to Respond to Written Opinion, Search Report and Written Opinion of Intellectual Property Office of Singapore issued in Application No. 11201405846Q dated Aug. 21, 2015 (8 pages).

Office Action and partial English translation issued by the Chinese Patent Office in Appln. No. 201380015690.1 dated Jul. 30, 2015 (8 pages).

* cited by examiner

REINFORCED GABION AND PROCESS FOR ITS MANUFACTURE

This invention relates to a reinforced gabion.

Gabions are substantially box-shaped structures with metal mesh walls, preferably but not exclusively double twisted hexagonal mesh, which are filled with pebbles, sand, stone or similar materials on the site where they are used. Gabions are used stacked alongside and on top of each other to make various civil engineering structures such as for example protective structures against ground erosion or platforms, or as reinforcing structures to consolidate the ground or foundations in the construction of river embankments and so on.

Gabions are generally in the form of a solid rectangle of greater length than width and height, and therefore comprise a bottom wall, which is generally designed to stand on the ground or on one or more underlying gabions when in use, to which are attached two lateral or side walls, a front wall and a rear wall. Gabions are closed off at the top by a top wall, generally connected to the rear wall, which acts as a lid to allow the gabion to be filled with filler material.

Gabions are manufactured in a factory and transported to the site where they are used in a flat folded configuration. These are then opened up and the various mesh panels are connected together to form the lidded box ready for use. After a gabion has been filled the top wall acting as a lid is secured to the front wall and the sides of the gabion to prevent the fill material from escaping. Typical uses of gabions, once filled and closed, are those of placing them alongside and on top of each other according to predetermined plans and configurations in such a way as to form a complex structure, which is sometimes quite extensive.

In making these complex structures, the visible walls of the outermost gabions are naturally subject to atmospheric agents and therefore have a tendency to become worn particularly quickly in comparison with the other walls of the same gabions. This is particularly obvious in the case where complex structures are immersed in water, which encourages corrosion of the most exposed mesh walls of the external gabions.

Another disadvantage to which the most exposed walls of gabions are subject is that of being more subject to deformation, because the thrust of the fill material on the outer walls of gabions under the action of its own weight and the weight of the overlying gabions or structures is not compensated for by contact with other adjacent gabions.

The most obvious solution to the abovementioned problems is that of making the gabion with a mesh which is more resistant to deformation and corrosion, for example with a stronger metal wire and/or one covered with plastics material. A gabion wholly constructed of such a mesh is obviously very much more expensive than normal, and is an unsatisfactory solution for which the market has little desire.

Solutions in which only some of the gabion walls have a stronger resistance to deformation and/or corrosion are also known. Solutions in which deformation of the walls is countered by tie rods or internal partition walls have for example been proposed. To improve the deformation and corrosion resistance of the front panel it has been suggested that it should be doubled, with another mesh panel fixed to it. Solutions in which some panels are made using a mesh whose strength has been increased through the insertion of reinforcing bars between the meshes have also been proposed.

All the solutions known to the applicant are however rather complex and do not achieve an optimum result in terms of deformation or corrosion resistance, or require long manufacturing times in comparison with the manufacture of normal unreinforced gabions of the conventional type.

The object of this invention is to solve the problems in the known art and in particular to provide, simply and economically, a reinforced gabion which has greater resistance in one or more walls, and in any event in its front wall, such that it can be advantageously used as an outermost gabion in a complex structure formed by adjacent and superimposed gabions. Another object of this invention is to provide a gabion that is simple and economical to use, as well as being reliable and safe. Another object of invention is to provide a process through which such a reinforced gabion can be manufactured with time and cost savings. Another object of the invention is to provide a process for the simple and economical manufacture of a metal mesh fabric suitable for the manufacture of a reinforced gabion. Another object of the invention is to provide a process of the type indicated above which can be effected using machinery of a known type without the need for any substantial modifications.

In order to achieve the above-mentioned objects this invention relates to a reinforced gabion having the characteristics indicated in the appended claims. The invention also relates to a process for the manufacture of such a gabion, as well as a process for manufacturing a double twist metal mesh fabric for use in the manufacture of such reinforced gabions.

According to one aspect of the invention, reinforced gabions have a box structure suitable for containing an inert material comprising two adjacent walls with a common edge, made using a single sheet of double twist metal mesh fabric formed of metal wires respectively having two diameters which differ from each other corresponding to the two walls.

According to another aspect of the invention, the double twist metal mesh of the single mesh fabric has meshes with at least one twisted side, formed of two metal wires woven together, in which each twisted side is aligned in the direction of the common edge between the two walls.

Preferably, but not restrictively, the double twist metal mesh fabric is a hexagonal mesh.

In other words the gabion has at least its front wall, which is longer than it is high, made of a double twist hexagonal mesh constructed of wire having a diameter greater than that of the double twist mesh fabric used for the other walls of the gabion. Preferably the twisted sides of the hexagons of the mesh fabric for the front wall are orientated along the length of the front wall and are therefore aligned in an effectively horizontal direction in the position in which the gabion is normally used. Such a configuration makes it possible to obtain a gabion whose front wall has greater strength due to the combined action of the greater wire diameter of the mesh and the horizontal orientation of the twisted sides of the mesh. According to another aspect of the invention, the single double twist metal mesh fabric is also formed of at least one wire having an intermediate diameter between the different diameters of the metal wires of the two adjacent walls located substantially at the common edge between the two adjacent walls.

The single double twist metal mesh fabric extends to form three or more reinforced gabion walls, and in particular may form the four larger walls of the reinforced gabion, to which the two sides are attached.

Thus in a preferred embodiment both the front wall and at least the bottom wall, and preferably also the rear wall, and even more preferably also the top wall of the gabion, are formed of a double twist hexagonal mesh fabric in which the mesh is orientated with the twisted sides of the hexagons all in the direction along the length of the walls and therefore all horizontally aligned in the position in which the gabion is normally used. The single mesh fabric comprises at least one portion manufactured with wires of larger diameter, corresponding to the front wall of the gabion. A particularly economical product is obtained in this way because the operation of stitching two different panels, with different strength characteristics, is eliminated, and the reinforced gabion can be manufactured with few stages in manufacture. This characteristic also favours folding of the gabion for transport from its flat extension, because the mesh of the fabric has less resistance to bending in the direction of the twisted sides, rather than transversely to them.

This invention also relates to a process for manufacturing a mesh fabric for the manufacture of gabions, comprising a portion of mesh fabric having a wire of smaller diameter and a portion of mesh fabric having a wire of larger diameter. The process essentially comprises the stages of providing a first group of wires of smaller diameter and placing these alongside a second group of wires of larger diameter, so that the complex of wires can be woven two by two alternately in such a way as to obtain a single mesh fabric with two portions of wires of different diameter. The fold defining the edge between two walls in the finished gabion, which may be the less strong bottom wall and the stronger front wall, is preferably provided in the transition zone between the zone of wires of smaller diameter and the zone of wires of larger diameter.

At least one wire of intermediate diameter can then be placed between the wires of larger diameter and the wires of smaller diameter, such as at the interface between two zones of different strength, that is substantially corresponding to the edge between two adjacent walls of different strength, thus limiting deformation of the mesh as much as possible.

Further features and advantages will be apparent from the following detailed description of a preferred embodiment of the invention with reference to the appended drawings, provided purely by way of a non-limiting example, in which.

Figure 1:
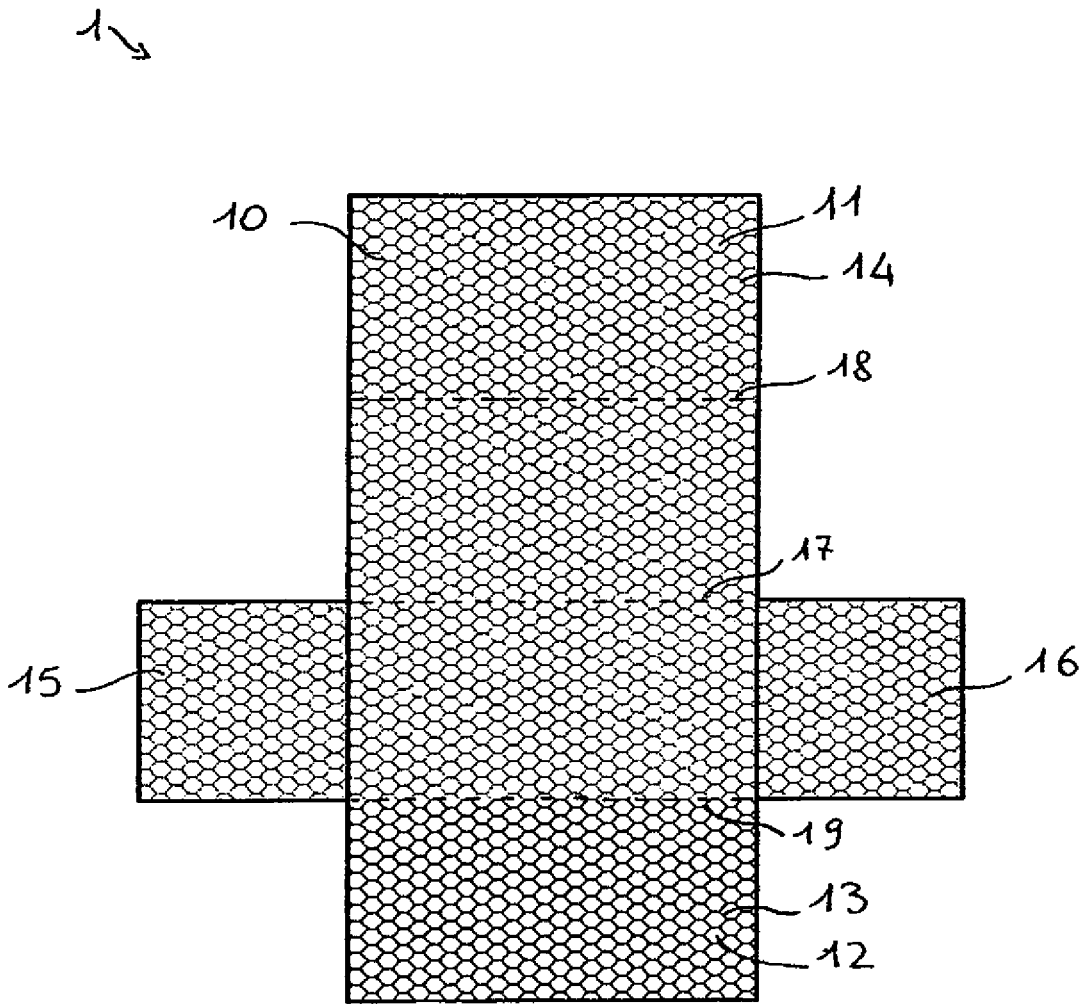
FIG. 1 illustrates a gabion according to this invention in a completely extended configuration.

With reference now to FIG. 1, a gabion 1 in a completely extended configuration comprises a plurality of double twist metal mesh fabrics. By the term "mesh fabric" is meant a single piece of mesh fabric woven in a single operation, that is without any joints or stitching. By "double twist mesh fabric" is generically meant a mesh fabric obtained from an array of wires extending substantially in the same direction that are twisted together. Preferably, but not restrictively, the wires are twisted together two by two to form a preferably hexagonal mesh. In the same woven area the wires are twisted together in the same direction of rotation (for example both clockwise or anticlockwise) and in the preferred embodiment of hexagonal mesh each wire is woven alternately in different areas of weaving with the wire located on its right and with the wire located on its left.

A first metal mesh fabric 10 comprises a first portion of mesh fabric 11 and a second portion of mesh fabric 12 manufactured with metal wires 14 and 13 respectively. Wires 13 have a greater diameter than wires 14, such that portion of mesh fabric 12 is manufactured with wires of greater diameter and therefore on the whole has greater strength than portion 11. Two panels 15 and 16 are joined laterally to mesh fabric 10. Mesh fabric 10 and panels 15 and 16, once joined together and folded along lines 17, 18 and 19, and along the joint between mesh fabric 10 and panels 15 and 16 comprise the six outer walls of a box structure, as may be seen in FIG. 2. In particular, first portion 11 of mesh fabric 10 comprises base 20, rear wall 21 and top wall 22, second portion 12 comprises front wall 23 and panels 15 and 16 form side walls 24 and 25 respectively.

Front wall 23 is therefore made using a wire 13 of diameter greater than wire 14 of which the other walls are made. The Applicant has found that optimum values for the diameters of wires 14 used to manufacture first portion 11 of mesh fabric 10 are between 2.2 and 3 mm, while wires 13 with which second portion 12 of mesh fabric 10 is made preferably have a diameter of between 3.4 and 3.9 mm. These values may obviously change depending upon the specific application without going beyond the scope of the invention.

Figure 2:
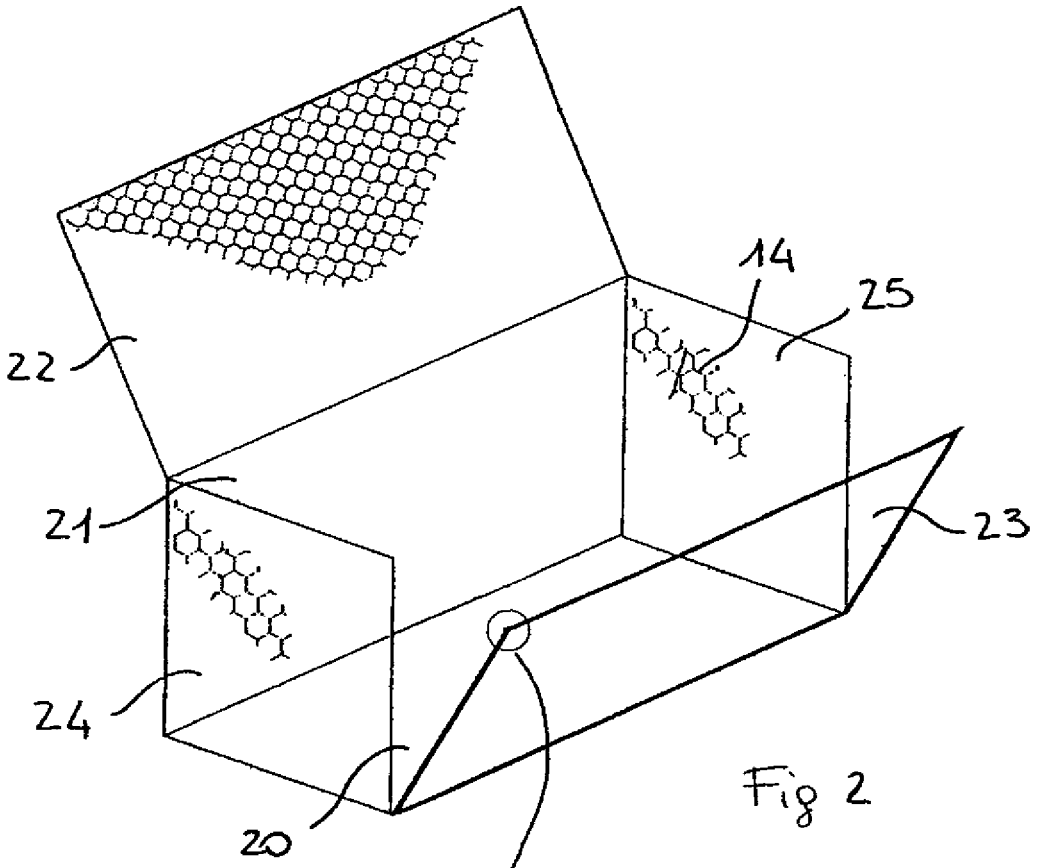
FIG. 2 illustrates the gabion in FIG. 1 when partly assembled.
Figure 3:
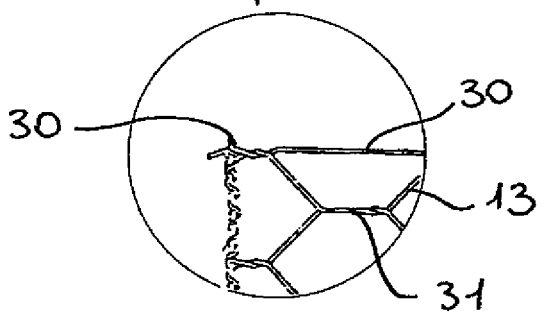
FIG. 3 shows a detail of FIG. 2 on a magnified scale.

As may be seen in FIG. 2 and in detail in FIG. 3, mesh fabric 10 and panels 15 and 16 are finished at their outer edge with profiled wires or cables 30. Also, regardless of the particular geometry of the mesh fabric, twisted sides 31 of each mesh fabric are parallel to each other, and in at least mesh fabric 10 are parallel to a plane on which base 20 lies. In other words, the metal wires making up the mesh are arranged substantially in a horizontal direction when the gabion is assembled and in use, in base 20, and in walls 21, 22 and 23. In this way mesh fabric 10 can be bent with greater ease for transport without any problems arising at the time when the box structure is erected.

In FIG. 1 side panels 15 and 16 are made of metal mesh fabric having wires of smaller diameter (that is similar to the diameter of the wires making up portion 11 of mesh fabric 10), attached to mesh fabric 10 by stitching, clipping or other known means of attachment. As in the figures, their orientation may be such that the twisted sides 31 of each mesh are substantially vertical, that is perpendicular to the plane of base 20. However one or both side panels may also be arranged with the twisted sides 31 of each mesh located substantially horizontally, that is parallel to the plane on which base 20 lies. Furthermore the side walls may also be made together with walls 20, 21, 22 and 23 in a single mesh fabric obtained from a single weaving and then cut to the desired shape.

One or both of side panels 15 and 16 may also be manufactured using a mesh fabric having wires of larger diameter. In particular, when it is desired to construct structures with several side by side and superimposed gabions, it is preferable that the gabions located on the outside of the structure should have all their exposed walls reinforced. For this reason it may in some cases also be preferable to manufacture top wall 22 of mesh fabric having wire of larger diameter.

When the difference between the wires of larger diameter 13 and the wires of smaller diameter 14 is substantial, in order to limit any deformation of the mesh fabric lying at the boundary between one zone manufactured using wire of smaller diameter and one zone manufactured using wire of larger diameter it is particularly advantageous that at least one wire of intermediate diameter should be inserted between a wire of smaller diameter and a wire of larger diameter, as better explained below with reference to the weaving process.

In the case of gabions having one side which is very much larger than the others additional panels may be provided fixed within the gabion to subdivide it into two or more parts. Such additional or divider panels are substantially of the same size as walls 24 and 25 and are secured within the gabion so that they are substantially parallel to them. Purely by way of example, a gabion of 1 m×1 m×2 m does not usually need dividers. It is however preferable that a longer gabion should be provided with them.

Figure 4:
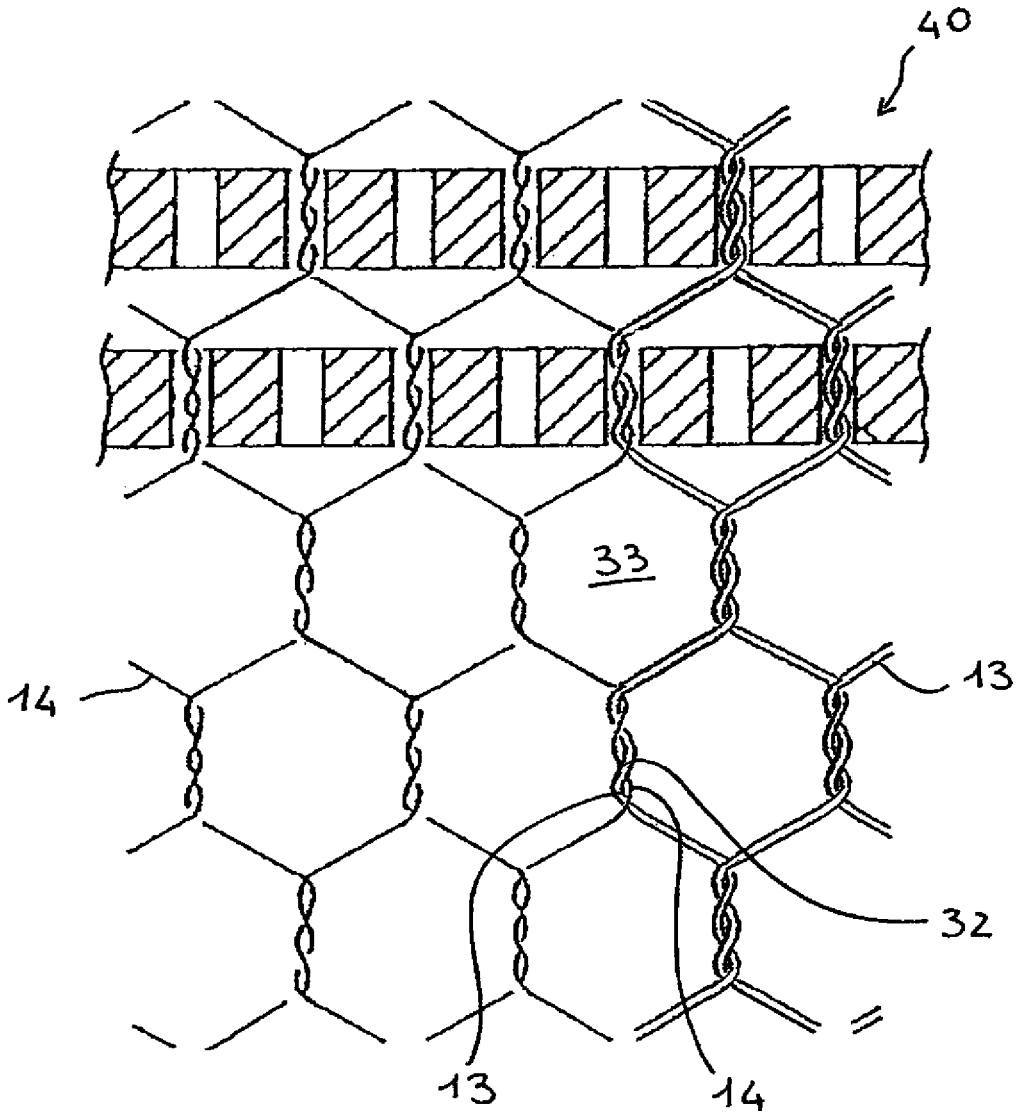
FIG. 4 shows diagrammatically the process for manufacturing a mesh fabric of zones of wires of different diameter to manufacture a mesh fabric for use in the manufacture of a gabion according to this invention.

As briefly indicated above, mesh fabric 10, with at least two portions thereof manufactured using wires of different diameter (and therefore of different strength) is manufactured in a single weaving operation. For this purpose a plurality of wires of larger diameter and wires 14 of smaller diameter are placed side by side in a frame 40 of a known type (see FIG. 4) and are woven together such that at the interface between a zone having wires of smaller diameter and a zone having wires of larger diameter portions of mesh fabric 32 are formed of a wire 14 of smaller diameter and a wire 13 of larger diameter woven together. In the preferred embodiment of a hexagonal mesh illustrated in the figure, each mesh 33 located at the interface between two zones of different strength has three sides made using wire 14 of smaller diameter and three sides made using wire 13 of larger diameter.

According to a variant of this invention, at least one wire of intermediate diameter is inserted between the plurality of wires 13 of larger diameter and the plurality of wires 14 of smaller diameter. The wires so located in mesh fabric 40 are then woven together two by two. In this way each wire of smaller diameter 14 is woven with another two wires of smaller diameter 14 or one wire of smaller diameter 14 and one wire of intermediate diameter, while each wire of larger diameter 13 is woven with a pair of wires of larger diameter 13 or one wire of larger diameter 13 and one wire of intermediate diameter. In this way the wire of larger diameter 13 is prevented from being directly woven with a wire of smaller diameter 14, limiting deformation of the intermediate meshes between the zones of different strength which may occur when the difference between the diameters of wires 13 and 14 is substantial.

Through the process described above the single mesh fabric having two portions of different strength is obtained through a simple and economical process. Obviously more than two portions of different strength may also be produced using the same process.

In order to manufacture a reinforced gabion, for example with only one reinforced front wall, a single mesh fabric manufactured as described above, having the width of the portion with wires of smaller diameter corresponding to the flanking dimension of base 20, rear wall 21 and top wall 22 may advantageously be provided, while the length of the adjacent portion with wires of greater diameter corresponds to the dimensions of front wall 23. Mesh panels 15 and 16 comprising side walls 24 and 25 respectively may be attached to this single mesh fabric to form as a whole the structure illustrated in FIG. 1 in which the reinforced gabion is in its fully extended configuration.

Of course, without prejudice to the principle of the invention, embodiments and details thereof may vary widely from what has been described and illustrated without thereby going beyond the scope of the invention.

The invention claimed is:

1. A reinforced gabion having a box structure capable of containing inert material, comprising two adjacent walls with a common edge made using a single sheet of double twisted metal mesh fabric formed of metal wires whose diameters differ from each other in the two walls.

2. A reinforced gabion according to claim 1, in which the double twisted metal mesh of the single mesh fabric has meshes with at least one twisted side, formed of at least two metal wires woven together, in which each twisted side is aligned in the direction of the common edge between the two walls.

3. A reinforced gabion according to claim 1, in which the double twisted metal mesh fabric is a hexagonal mesh fabric.

4. A reinforced gabion according to claim 1, in which the single double twisted metal mesh fabric is also formed of at least one wire having a diameter intermediate between the different diameters of the metal wires of the two adjacent walls located substantially at the common edge between the two adjacent walls.

5. A reinforced gabion according to claim 1, in which the single double twisted metal mesh fabric extends to form three or more walls of the reinforced gabion.

6. A process for manufacturing a double twisted metal mesh fabric for the manufacture of a reinforced gabion comprising the stages of:

placing a plurality of metal wires comprising at least one first group of wires having a first diameter and a second group of wires having a second diameter alongside each other in a frame; and weaving together pairs of adjacent wires to form a single double twisted metal mesh fabric having at least a first portion formed of wires of a first diameter and at least a second portion formed of wires of a second diameter woven together.

7. A process for manufacturing a metal mesh fabric according to claim 6, in which the plurality of metal wires also comprise at least one metal wire of diameter intermediate between the first and the second diameter placed between the first and second groups of metal wires.

8. A process for manufacturing a reinforced gabion having a box structure capable of containing inert material, the box structure comprising two adjacent walls with a common edge made using a single sheet of double twisted metal mesh fabric formed of metal wires whose diameters differ from each other in the two walls, comprising the stages of:

manufacturing a single sheet of metal mesh fabric by:

placing a plurality of metal wires comprising at least one first group of wires having a first diameter and a second group of wires having a second diameter alongside each other in a frame, weaving together pairs of adjacent wires to form a single double twisted metal mesh fabric having at least a first portion formed of wires of a first diameter and at least a second portion formed of wires of a second diameter woven together, folding the single sheet of metal mesh fabric to form two adjacent walls of the reinforced gabion with a common edge formed respectively from metal wires having two different respective diameters, and forming the remaining walls of the box-structure reinforced gabion with double twisted metal mesh fabric.

* * * * *